United States Patent [19]

Ohkubo et al.

[11] 3,985,964

[45] Oct. 12, 1976

[54] 4-CHANNEL STEREOPHONIC DEMODULATING SYSTEM

[75] Inventors: Tsuneo Ohkubo, Katano; Yoshio Horiike, Neyagawa, both of Japan

[73] Assignee: Matsushita Electric Industrial Co., Ltd., Osaka, Japan

[22] Filed: Oct. 24, 1974

[21] Appl. No.: 517,610

Related U.S. Application Data

[63] Continuation of Ser. No. 314,673, Dec. 13, 1972, abandoned.

[30] Foreign Application Priority Data

| | | |
|---|---|---|
| Dec. 16, 1971 | Japan | 46-103088 |
| Dec. 16, 1971 | Japan | 46-103089 |
| Dec. 16, 1971 | Japan | 46-103090 |
| May 29, 1972 | Japan | 47-53723 |
| May 29, 1972 | Japan | 47-53724 |
| May 29, 1972 | Japan | 47-53725 |

[52] U.S. Cl. ..... 179/15 BT; 179/100.4 ST; 179/100.1 TD

[51] Int. Cl.[2] ..... H04H 5/00; H04R 5/00

[58] Field of Search ..... 179/1 GQ, 15 BT, 1 G, 179/100.4 ST, 100.1 TD

[56] References Cited

UNITED STATES PATENTS

| | | | |
|---|---|---|---|
| 3,211,834 | 10/1965 | Okatani | 179/15 BT |
| 3,315,038 | 4/1967 | Zwollo | 179/15 BT |
| 3,573,382 | 4/1971 | Frit | 179/15 BT |
| 3,584,154 | 6/1971 | McShan | 179/15 BT |
| 3,707,603 | 12/1972 | Limberg | 179/15 BT |
| 3,708,623 | 1/1973 | Dorren | 179/15 BT |
| 3,711,652 | 1/1973 | Metro | 179/15 BT |
| 3,721,766 | 3/1973 | Hibert | 179/15 BT |
| 3,732,375 | 5/1973 | Kuribavashi | 179/15 BT |
| 3,883,692 | 5/1975 | Tsurshima | 179/1 GQ |

*Primary Examiner*—Douglas W. Olms
*Attorney, Agent, or Firm*—Stevens, Davis, Miller & Mosher

[57] ABSTRACT

A 4-channel stereophonic demodulating system based on a switching mode, which comprises a plurality of switching means for demodulating a received 4-channel stereophonic composite signal under control by a first and a second switching signals obtained from a pilot signal, means to separately derive four stereophonically related signals at the respective output terminals of said switching means, and adding means to add plural output signals from at least one switching means to each other. The signal levels of the individual channel signal components are adjustable by said adding means relative to one another to enable separation adjustment, so that in each of the four stereophonically related signals which appear at respective output terminals of the system, cross-talk due to the other signals is reduced.

17 Claims, 14 Drawing Figures

4-CHANNEL STEREOPHONIC DEMODULATING SYSTEM

This is a continuation of application Ser. No. 314,673, filed Dec. 13, 1972, now abandoned.

The present invention relates to 4-channel stereophonic demodulating systems and, more particularly, to 4-channel stereophonic demodulators capable of separating stereophonically related signals free from cross-talk.

In the broadcast of 2-channel stereophonic composite signals only the basic wave components of subchannel signals are used in order that the composite signals may be transmitted in as narrow a bandwidth as possible. When the composite signals are produced by switching, the resulting signals become rectangular signals, which involve a number of harmonics. Such harmonics are not desirable and hence are removed by filtering. Then only the basic wave components are transmitted in which the main channel signal is made to have a level equal to that of the subchannel signal. However, when a main channel signal and a subchannel signal with an equal level are applied to a 2-channel stereophonic demodulator of the switching type, it extracts a demodulated output signal in which the signal level of the subchannel signal component is lower than that of the main channel component. Therefore, full separation cannot be achieved.

In the broadcast of 4-channel composite signals it is also desired to transmit only the basic wave components of subchannel signals in as narrow a bandwidth as possible. In a demodulator for demodulating a 4-channel composite signal by switching, when the main channel signal and the first, second and third subchannel signal components are applied all with the same level thereto it is likely, as in the 2-channel stereophonic demodulator, that it will be necessary to only adjust the signal levels between the main channel signal component and the subchannel signal components. This is because when the respective subchannel signals having the same level are demodulated the demodulated subchannel components are also of the same level, so that the level adjustment between the subchannel signals becomes unnecessary. Accordingly, the separation of the applied composite signal is fully achieved only by the level adjustment between the main channel signal and the subchannel signals.

However, if the above-mentioned 4-channel composite signal includes first, second and third subchannel signals having different levels relative to one another, the above-mentioned method cannot perform full separation.

Therefore, it is an object of the invention to provide a 4-channel stereophonic demodulating system based on a switching mode which includes switching means adapted to adjust possible different signal levels of the subchannel signal components to thereby improve the separation.

Another object of the invention is to provide a 4-channel stereophonic demodulating system, in which the signal levels of the individual channel signal (including a main channel) components are adjustable relative to one another, thereby reducing the cross-talk of each of the four stereophonically related signals contained in the other ones when these signals appear at respective output terminals of the system.

According to this invention there is provided a 4-channel stereophonic demodulating system for demodulating a 4-channel stereophonic composite signal containing a main channel signal component constituted by a first one of four different combinations of signals, said combinations of signals being obtained additively and/or subtractively from four signals stereophonically related to one another, a first subchannel signal component obtained through suppressed-carrier amplitude modulation of a second one of said combinations of signals, a second subchannel signal component obtained through suppressed-carrier amplitude modulation of a third one of said combinations of signals on a subcarrier wave 90° out of phase with respect to said first subchannel signal component, a third subchannel signal component obtained through suppressed-carrier amplitude modulation of a fourth one of said combinations of signals on a subcarrier wave at double the frequency of said first and second subcarrier signal components, and a pilot signal, said demodulating system comprising:

switching means to demodulate the afore-said 4-channel stereophonic composite signal containing subchannel signals at different levels under control by a first switching signal and a second switching signal both said switching signals being produced from said pilot signal;

means to separately derive said four signals stereophonically related to one another from the outputs of said switching means; and adding means to add a pair of output signals from at least one of said switching means to each other.

The above and other objects, features and advantages of this invention will become more apparent from the following detailed description when taken in conjunction with the accompanying drawings, in which.

Figure 9A:
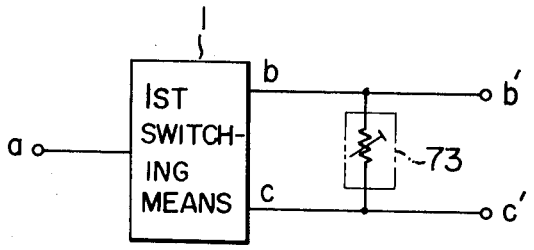
Figure 9B:
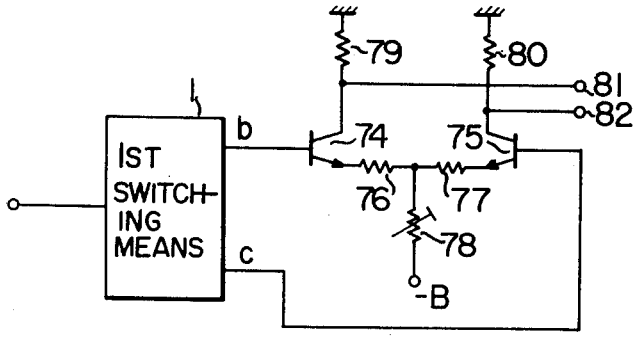
Figure 10:
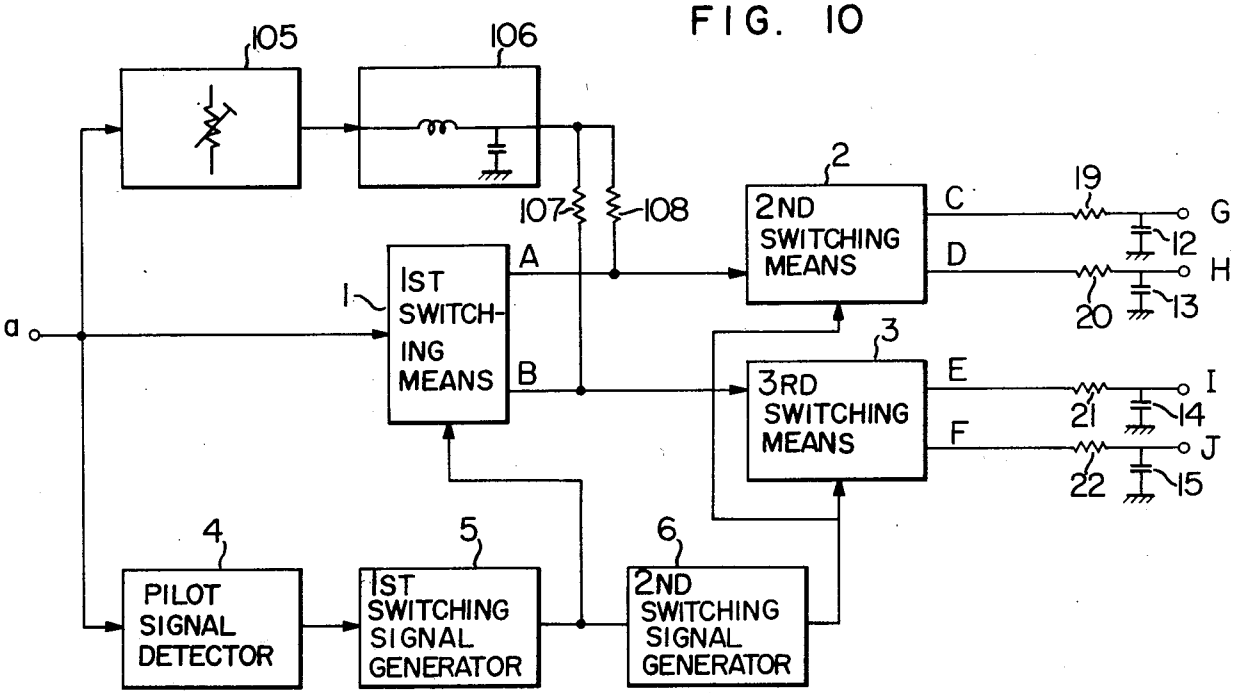
Figure 11:
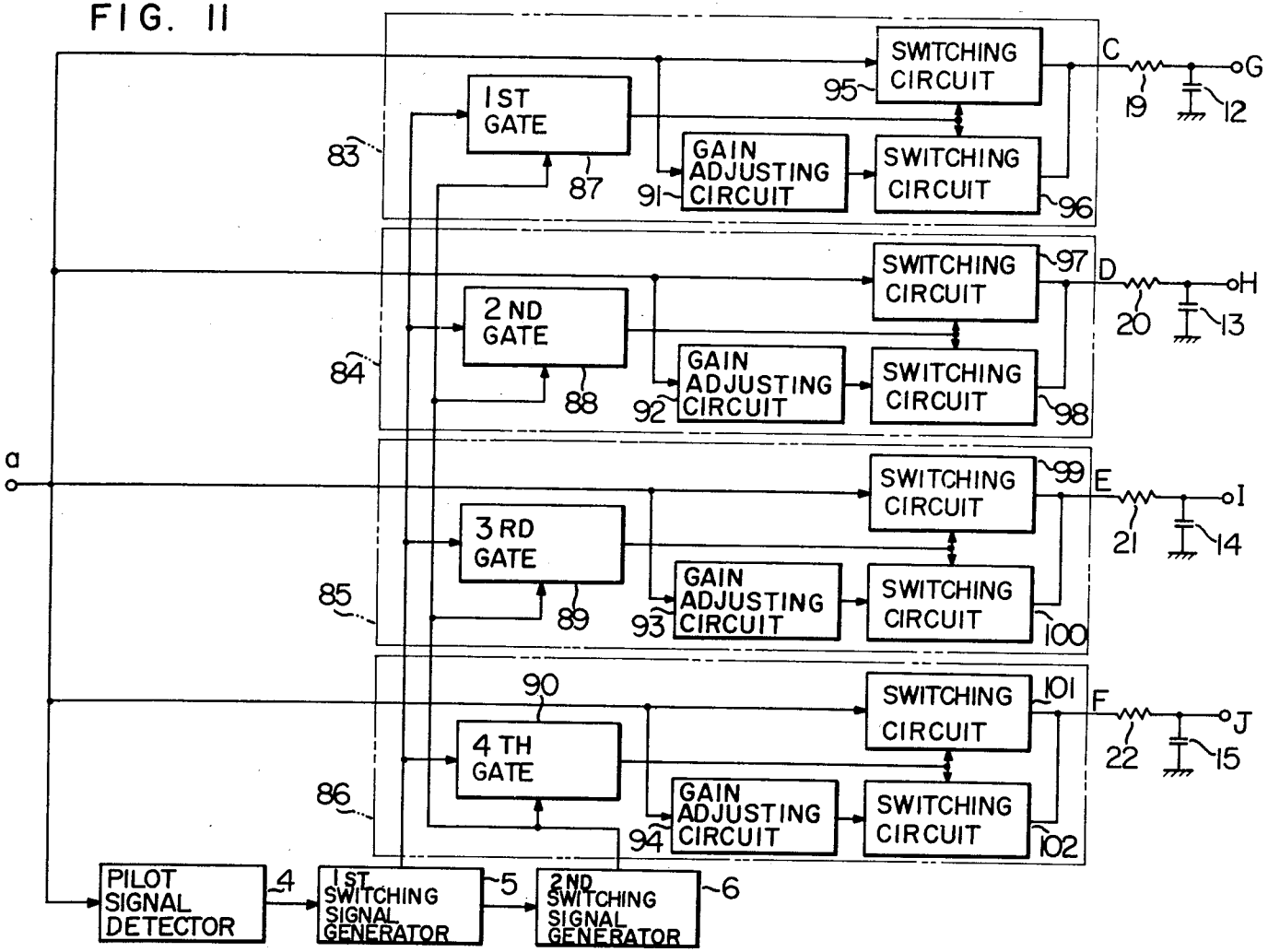
Figure 12:
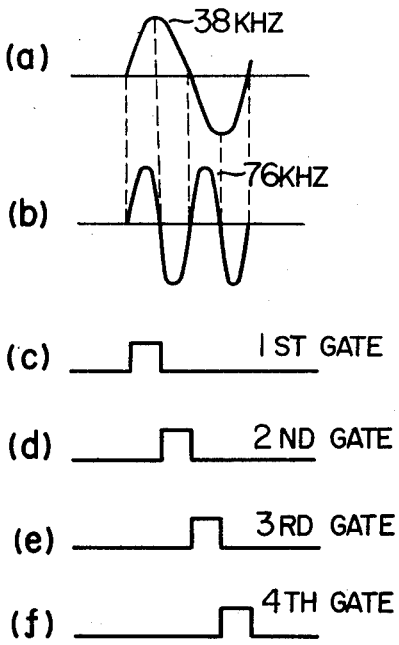
Figure 13:
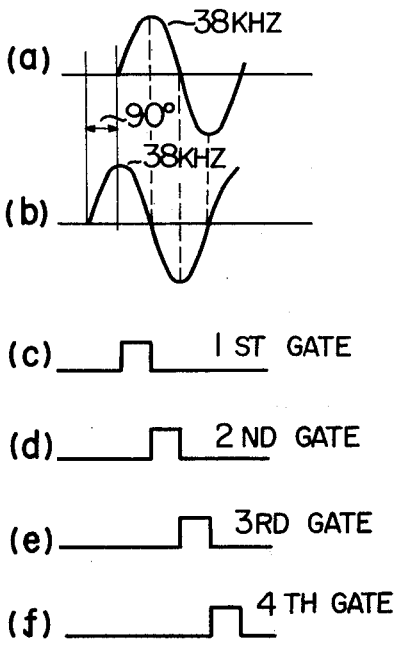

FIGS. 9*a* and 9*b* show examples of the adding circuit for use in the 4-channel stereophonic demodulating system according to the invention;

FIGS. 10 and 11 are block form representations of further embodiments of the 4-channel stereophonic demodulating system according to the invention; and FIGS. 12 and 13 are waveform charts showing examples of the operation mode of the embodiment of FIG. 11.

Figure 1:
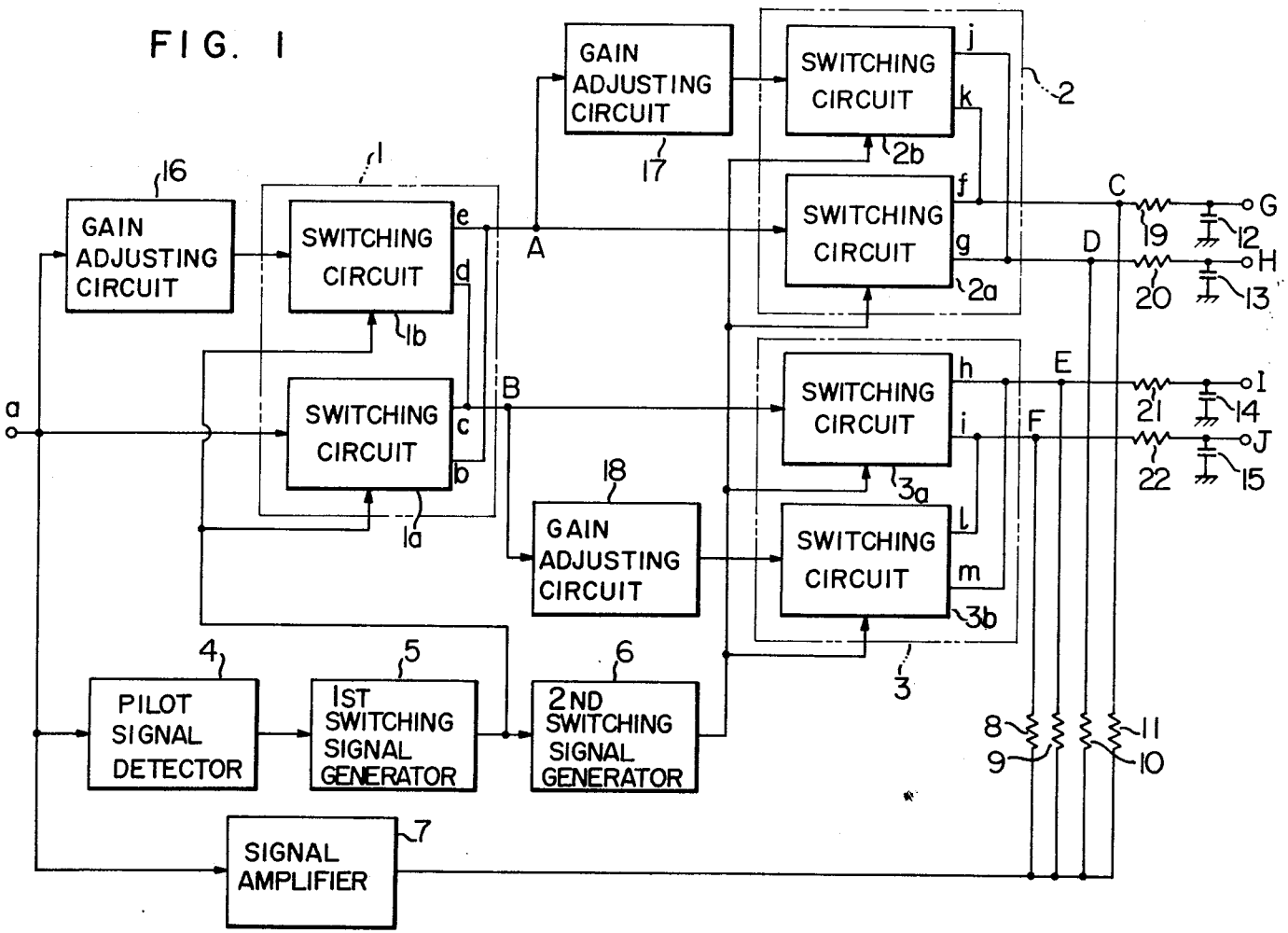
FIG. 1 is a block form representation of an embodiment of the 4-channel stereophonic demodulating system according to the invention.

Referring now to FIG. 1, which shows a preferred embodiment of the 4-channel stereophonic demodulating circuit according to the invention, indicated at *a* is a stereophonic composite signal input terminal. It is now assumed that there appears at the input terminal *a* a stereophonic composite signal containing individual channel components at different levels and represented by an equation $$M(t) = A + K_1B \sin \omega t + K_2C \cos \omega t + K_3D \sin 2\omega t + K \sin (\omega/2)t \quad (1)$$

In equation 1, the factors A, B, C and D are respectively given as $$A = L_1 + L_2 + R_1 + R_2$$
$$B = L_1 + L_2 - R_1 - R_2$$
$$C = L_1 - L_2 - R_1 + R_2 \text{ and}$$
$$D = L_1 - L_2 + R_1 - R_2$$

where $L_1$, $L_2R_1$ and $R_2$ represent four stereophonically related signals, namely $L_1$ is a left front signal, $L_2$ left rear signal, $R_1$ right front signal, and $R_2$ right rear signal, $K$, $K_1$, $K_2$ and $K_3$ are constants, and $\omega/2\pi = 38$ (kHz). The first term in equation 1 represents a main channel signal, the second term a first sub-channel signal, the third term a second sub-channel signal, the fourth term a third sub-channel signal, and the fifth term a pilot signal. (Essentially, the factor C in the third term and the factor D in the fourth term are interchangeable.)

Figure 2:
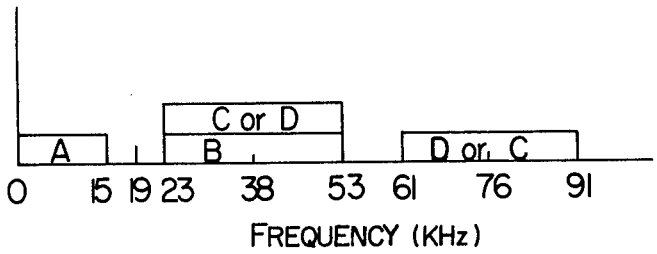
FIG. 2 shows bandwidth requirements for 4-channel stereophonic composite signals to be dealt with in accordance with the invention.
Figure 3:
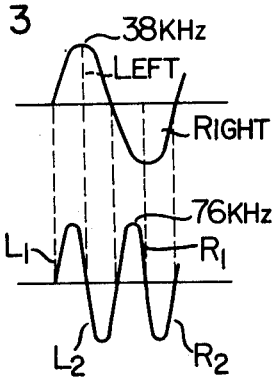
FIGS. 3 and 4 show examples of the order of occurrence of the individual stereophonically related signals.
Figure 4:
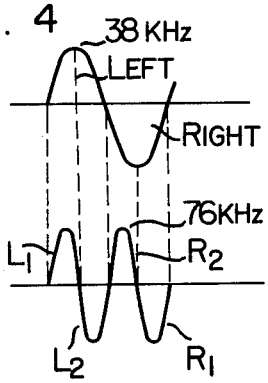

FIG. 2 shows a spectral chart of frequency requirements for the signal represented by equation 1. FIG. 3 shows waveforms involved in the switching mode based on equation 1. In this mode, the left and right signals are respectively contained in the first and second halves of the 38-kHz cycle. More specifically, the 38-kHz cycle is divided into quarter periods (each being one half of the 76-kHz cycle), which are successively allotted to $L_1$, $L_2$, $R_1$ and $R_2$ signals. FIG. 4 shows another mode, which results when the factor C in the third term and the factor D in the fourth term in equation 1 are interchanged. In this mode, the left and right signals are also contained in the respective first and second halves of the 38-kHz cycle, but the quarter divisions are successively allotted in the order of $L_1$, $L_2$, $R_2$ and $R_1$.

The stereophonic composite signal of equation 1 which is applied to the input terminal *a* is applied as an input to one of paired switching circuits, namely switching circuit 1a, of a first switching means 1, to a pre-stage circuit 16 (a gain adjusting circuit) connected to the input of the other switching circuit 1*b*, to a pilot signal detector 4 and to a signal amplifier 7. The pilot signal detector 4 selectively derives only the pilot signal in the stereophonic composite signal, and the pilot signal derived here is applied to a first switching signal generator 5, where it is converted into a first switching signal (related to a first subcarrier wave here). The first switching signal obtained from the first switching signal generator 5 is used to switch the stereophonic composite signal applied to the switching circuit la in the first switching means 1. If the first subcarrier wave is used as the first switching signal, output signals appearing from respective output terminals b and c of the switching circuit 1a have respective forms given by the following equations 2 and 3:

$$P_1M(t) = \frac{1}{2}\left\{(1 + \frac{2}{\pi}K_1)(L_1 + L_2) + (1 - \frac{2}{\pi}K_1)(R_1 + R_2)\right\} + \frac{1}{2}K_3\left\{(L_1 - L_2) + (R_1 - R_2)\right\} \sin 2\omega t + \frac{1}{\pi}K_2\left\{(L_1 - L_2) - (R_1 - R_2)\right\}\left\{(1 + \frac{1}{3}) \sin 2\omega t + (\frac{1}{5} + \frac{1}{7}) \sin 6\omega t + \ldots\right\} \quad (2)$$

and $$Q_1M(t) = \frac{1}{2}\left\{(1 - \frac{2}{\pi}K_1)(L_1 + L_2) + (1 + \frac{2}{\pi}K_1)(R_1 + R_2)\right\} + \frac{1}{2}K_3\left\{(L_1 - L_2) + (R_1 - R_2)\right\} \sin 2\omega t - \frac{1}{\pi}K_2\left\{(L_1 - L_2) - (R_1 - R_2)\right\}\left\{(1 + \frac{1}{3}) \sin 2\omega t + (\frac{1}{5} + \frac{1}{7}) \sin 6\omega t + \ldots\right\} \quad (3)$$

In equations 2 and 3, $P_1$ and $Q_1$ are switching functions, and in the case of using the first subcarrier wave ($\sin \omega t$) as the switching signal added to the switching circuit 1a of the switching means 1 they are given as $$P_1 \approx \frac{1}{2} + \frac{2}{\pi} \sin \omega t + \frac{2}{3\pi} \sin 3\omega t + \quad (4)$$

and $$Q_1 \approx \frac{1}{2} - \frac{2}{\pi} \sin \omega t - \frac{2}{3\pi} \sin 3\omega t - \quad (5)$$

Meanwhile, the stereophonic composite signal applied to the gain adjusting circuit 16 is multiplied therein by $\alpha(\alpha > 0$ or $\alpha < 0)$, and $\alpha$ times the stereophonic composite signal is switched in the switching circuit 1*b*, similar to the afore-mentioned switching in the switching circuit 1*a*. by the first switching signal (i.e., the first subcarrier wave here, with switching functions $P_1$ and $Q_1$ obtained from the first switching signal generator 5. Thus, $\alpha$ times the signals of equations 2 and 3, that is, signals to $\alpha P_1M(t)$ and $aQ_1M(t)$ appear at respective output terminals*d* and *e* of the switching circuit 1*b*.

The signals appearing at the output terminals *d* and *e* of the switching circuit 1*b* are additively combined with the respective signals appearing at the output terminals *c* and *b* of the switching circuit 1*a*. Here, if output signals from the switching circuits 1*a* and 1*b* and to be combined with each other are respectively based on different switching functions $P_1$ and $Q_1$, the resultant sum combinations to be applied to switching circuits 2*a* and 3*a* of the next-stage second and third switching means 2 and 3 and to circuits 17 and 18 are respectively $$P_1 M(t) + \alpha Q_1 M(t) =$$

$$\frac{1}{2}A(1+\alpha) + \frac{2}{\pi}K_1(1-\alpha)B$$

$$+ \frac{1}{2}K_3D(1+\alpha)\sin 2\omega t$$

$$+ \frac{1}{\pi}K_3C(1-\alpha)\left\{(1+\frac{1}{3})\sin 2\omega t + \ldots\right\}$$

$$= \frac{1}{2}[\left\{(1+\alpha) + \frac{2}{\pi}K_1(1-\alpha)\right\}(L_1+L_2)$$

$$+ \left\{(1+\alpha) - \frac{2}{\pi}K_1(1-\alpha)\right\}(R_1+R_2)]$$

$$+ \frac{1}{2}K_3(1+\alpha)\left\{(L_1-L_2)+(R_1-R_2)\right\}\sin 2\omega t$$

$$+ \frac{1}{\pi}K_2(1-\alpha)\left\{(L_1-L_2)-(R_1-R_2)\right\}$$

$$\left\{(1+\frac{1}{3}\sin 2\omega t + \ldots\right\} \qquad (6)$$

and $$Q_1 M(t) + \alpha P_1 M(t) =$$

$$\frac{1}{2}A(1+\alpha) - \frac{2}{\pi}K(1-\alpha)B + \frac{1}{2}K_3D(1+\alpha)\sin 2\omega t$$

$$- \frac{1}{\pi}K_2C(1-\alpha)\left\{(1+\frac{1}{3})\sin 2\omega t + \ldots\right\}$$

$$= \frac{1}{2}[\left\{(1+\alpha) - \frac{2}{\pi}K_1(1-\alpha)\right\}(L_1+L_2)$$

$$+ \left\{(1+\alpha) + \frac{2}{\pi}K_1(1-\alpha)\right\}(R_1+R_2)]$$

$$+ \frac{1}{2}K_3(1+\alpha)\left\{(L_1-L_2)+(R_1-R_2)\right\}\sin 2\omega t$$

$$- \frac{1}{\pi}K_2(1-\alpha)\left\{(L_1-L_2)-(R_1-R_2)\right\}\left\{(1+\frac{1}{3}\sin 2\omega t + \ldots\right\} \qquad (7)$$

Accordingly, by setting $$K_3(1+\alpha) = K_2(1-\alpha) \qquad (8)$$

we may provide the same level for the second subchannel signal component as for the third subchannel signal component. Equation 8 may be expressed as $$\alpha = \frac{K_2 - K_3}{K_2 + K_3} \qquad (9)$$

and we may set $\alpha$ for the gain adjusting circuit 16 as in equation 9. That is, it will be understood that the switching means 1 including two switching circuits 1*a* and 1*b* can adjust the levels of the second and third signal components.

The output signal of the first signal generator 5 is also applied to a second switching signal generator 6 to thereby produce a second switching signal, which is supplied to switching circuits 2*a*, 2*b*, 3*a* and 3*b* of the second and third switching means 2 and 3 for the switching of the sum combinations of signals from the first switching means which are supplied from terminals A and B to these switching circuits 2*a*, 2*b*, 3*a* and 3*b*. Denoting the switching functions of the switching by the second switching signal by $P_2$ and $Q_2$, output signals expressed as $$P_2\left\{P_1 M(t) + \alpha Q_1 M(t)\right\} = \frac{1}{4}A(1+\alpha) + \frac{1}{\pi}K_1B(1-\alpha)$$

$$+ \frac{1}{\pi}K_3D(1+\alpha) + \frac{1}{\pi}K_2C(1-\alpha)$$

$$Q_2\left\{P_1 M(t) + \alpha Q_1 M(t)\right\} = \frac{1}{4}A(1+\alpha) + \frac{1}{\pi}K_1B(1-\alpha)$$

$$- \frac{1}{\pi}K_3D(1+\alpha) - \frac{11}{\pi}K_2C(1-\alpha)$$

$$P_2\left\{Q_1 M(t) + \alpha P_1 M(t)\right\} = \frac{1}{4}A(1+\alpha) - \frac{1}{\pi}K_1B(1-\alpha)$$

$$+ \frac{1}{\pi}K_3D(1+\alpha) - \frac{1}{\pi}K_2C(1-\alpha)$$

$$Q_2\left\{Q_1 M(t) + \alpha P_1 M(t)\right\} = \frac{1}{4}A(1+\alpha) - \frac{1}{\pi}K_1B(1-\alpha)$$

$$- \frac{1}{\pi}K_3D(1+\alpha) - \frac{1}{\pi}K_2C(1-\alpha)$$

appear at respective output terminals *f*, *g*, *h* and *i* of the switching circuits 2*a* and 3*a*. Meanwhile, gain adjusting circuits 17 and 18 multiply respective signals of equations 6 and 7 by $\beta(\beta>0$ or 62 $\beta$ 0), and $\beta$ times these signals are applied to the respective switching circuits 2*b* and 3*b*. Thus, output signals expressed as $\beta P_2\{P_1M(t) + \alpha Q_1M(t)\}$
$\beta Q_2\{P_1M(t) + \alpha Q_1M(t)\}$
$\beta P_2\{Q_1M(t) + \alpha P_1M(t)\}$ and
$\beta Q_2\{Q_1M(t) + \alpha P_1M(t)\}$ appear at respective output terminals j, k, l and m.

Signals related to either the second or third subcarrier wave may be used as the second switching signal. In the case of using the third subcarrier wave as the second switching signal, the switching functions $P_2$ and $Q_2$ can be expressed as $$P_2 \approx \frac{1}{2} + \frac{2}{\pi}\sin 2\omega t + \frac{2}{3\pi}\sin 6\omega t + \quad (10)$$

and $$Q_2 \approx \frac{1}{2} - \frac{2}{\pi}\sin 2\omega t - \frac{2}{3\pi}\sin 6\omega t - \quad (11)$$

and in the case of using the second subcarrier wave they are $$P_2 \approx \frac{1}{2} + \frac{2}{\pi}\cos \omega t - \frac{2}{3\pi}\cos 3\omega t \quad (12)$$

and $$Q_2 \approx \frac{1}{2} - \frac{2}{\pi}\cos \omega t + \frac{2}{3\pi}\cos 3\omega t \quad (13)$$

The signals appearing at the output terminals *f*, *g*, *h* and *i* of the switching circuits 2*a* and 3*a* are additively combined with the respective signals appearing at the output terminals *k*, *j*, *l* and *m* of the switching circuits 2*b* and 3*b*. In the case of using the third subcarrier wave as the second switching signal, the resultant sum combinations appearing at respective terminals are respectively given as $$\begin{aligned}
&P_2\{P_1M(t) + \alpha Q_1M(t)\} + \{\beta Q_2\ P_1M(t) + \alpha Q_1M(t)\} \\
&= \frac{1}{4}A(1+\alpha)(1+\beta) + \frac{1}{\pi}K_1B(1-\alpha)(1+\beta) \\
&+ \frac{1}{\pi}K_3D(1+\alpha)(1-\beta) + \frac{1}{\pi}K_2C(1-\alpha)(1-\beta) \\
&= \frac{1}{4}(1+\beta)[\left\{(1+\alpha) + \frac{2}{\pi}K_1(1-\alpha)\right\}(L_1+L_2) \\
&+ \left\{(1+\alpha) - \frac{2}{\pi}K_1(1-\alpha)\right\}(R_1+R_2)] \\
&+ \frac{1}{\pi}K_2(1-\alpha)(1-\beta)(L_2-L_2) \quad (14)
\end{aligned}$$

$$\begin{aligned}
&Q_2\{P_1M(t) + \alpha Q_1M(t)\} + \beta P_2\{P_1M(t) + \alpha Q_1M(t)\} \\
&= \frac{1}{4}A(1+\alpha)(1+\beta) + \frac{1}{\pi}K_1B(1-\alpha)(1+\beta) \\
&- \frac{1}{\pi}K_3D(1+\alpha)(1-\beta) - \frac{1}{\pi}K_2C(1-60\ )(1-\beta) \\
&= \frac{1}{4}(1+\beta)[\left\{(1+\alpha) + \frac{2}{\pi}K_1(1-\alpha)\right\}(L_1+L_2) \\
&+ \left\{(1+\alpha) - \frac{2}{\pi}K_1(1-\alpha)\right\}(R_1+R_2)] \\
&- \frac{1}{\pi}K_2(1-\alpha)(1-\beta)(L_1-L_2) \quad (15)
\end{aligned}$$

$$\begin{aligned}
&P_2\{Q_1M(t) + \alpha P_1M(t)\} + \beta Q_2\{Q_1M(t) + \alpha P_1M(t)\} \\
&= \frac{1}{4}A(1+\alpha)(1+\beta) - \frac{1}{\pi}K_1B(1-\alpha)(1+\beta) \\
&+ \frac{1}{\pi}K_3D(1+\alpha)(1-\beta) - \frac{1}{\pi}K_2C(1-\alpha)(1-\beta) \\
&= \frac{1}{4}(1+\beta)[\left\{(1+\alpha) - \frac{2}{\pi}K_1(1-\alpha)\right\}(L_1+L_2) \\
&+ \left\{(1+\alpha) + \frac{2}{\pi}K_1(1-\alpha)\right\}(\mathrm{I}\,R_1+R_2)]
\end{aligned}$$

-continued $$\begin{aligned}
&+ \frac{1}{\pi}K_2(1-\alpha)(1-\beta)(R_1-R_2) \quad (16)
\end{aligned}$$

and $$\begin{aligned}
&Q_2\{Q_1M(t) + \alpha P_1M(t)\} + \beta P_2\{Q_1M(t) + \alpha P_1M(t)\} \\
&= \frac{1}{4}A(1+\alpha)(1+\beta) - \frac{1}{\pi}K_2B(1-\alpha)(1+\beta) \\
&- \frac{1}{\pi}K_3D(1+\alpha)(1-\beta) + \frac{1}{\pi}K_2C(1-\alpha)(1-\beta) \\
&= \frac{1}{4}(1+\beta)[\left\{(1+\alpha) - \frac{2}{\pi}K_1(1-\alpha)\right\}(L_1+L_2) \\
&+ \left\{(1+\alpha) + \frac{2}{\pi}K_1(1-\alpha)\right\}(R_1+R_2)] \\
&- \frac{1}{\pi}K_2(1-\alpha)(1-\beta)(R_1-\mathrm{R}_2) \quad (17)
\end{aligned}$$

where $$\alpha = \frac{K_2 - K_3}{K_2 + K_3}$$

as mentioned earlier. Accordingly, the level adjustment with respect to the first and second sub-channel signal components can be achieved by setting $$K_1(1-\alpha)(1+\beta) = K_2(1-\alpha)(1-\beta) \quad (18)$$

that is, by adjusting the gain adjusting circuits 17 and 18 such as satisfy the condition $$\beta = \frac{K_2 - K_1}{K_2 + K_1} \quad (19)$$

That is, it will be understood that the switching means 2 and 3 respectively using two switching circuits 2*a*, 2*b* and 3*a*, 3*b* can adjust the levels of the first and second subchannel signal components.

In case of using the second subcarrier wave in place of the third subcarrier wave as the second switching signal, we may set $$\alpha = \frac{K_3 - K_2}{K_2 + K_3} \quad (20)$$

$$\beta = \frac{K_3 - K_1}{K_1 + K_3} \quad (21)$$

It will be understood from the above equations that the use of the two switching circuits 1a and 1b in the switching means 1 enables the adjustment of the levels of the second and third subchannel signal components and the use of the two switching circuits 2*a*, 2*b* and 3*a*, 3*b* in the switching means 2 and 3 respectively enable the adjustment of the levels of the third and first subchannel components. Provided the constants in equation 1 are related such as $1 > K_1 > K_2 > K_3$, the factors $\alpha$ and $\beta$ are restricted from equations 9 and 19 to be $\alpha > 0$ and $\beta < 0$ when the third subcarrier wave is used while they are restricted from equations 20 and 21 to be $\alpha < 0$ and $\beta > 0$ when the second subcarrier wave is used. Depending upon the constants in equation 1, however, the factors $\alpha$ and $\beta$ can be set to various positive and negative values.

Furthermore, depending upon the values of $K_1$ and $K_2$ the signals applied to the switching circuits 2*b* and 3*b* of the respective switching means 2 and 3 for switching need not be produced (that is, it is possible to set $\beta = 0$). More particularly, if a condition $K_1 = K_2$ holds for the sum combinations of signals of the first switching means and appearing at the terminals A and B, no addition between the output signals of the paired switching circuits of the first switching means is necessary in order to reject unwanted cross-talk. Also, if $K_2 = K_3$ and $K_1 \neq K_2$(or if $K_1 = K_3$ and $K_1 \neq K_2$) for the input signals to the first switching means, such addition is required only in the switching circuits in the second and third switching means, but is not required in the first switching means.

To the signals obtained from the second and third switching means 2 and 3 at respective terminals C, D, E and F, are added respective in-phase or 180-degree out-of-phase 4-channel composite signals obtained from the signal amplifier 7 through respective resistors 8, 9, 10 and 11, and thus, separate $L_1$, $L_2$, $R_1$ and $R_2$ signals can be obtained at respective output terminals G, H, I and J with the main channel signal level adjusted with respect to the first, second, and third subchannel signals whose levels have been adjusted with respect to one another as mentioned earlier. At this time, capacitors 12, 13, 14 and 15 in respective de-emphasis circuits serve to remove high frequency subchannel signal components contained in the 4-channel stereophonic composite signal coupled through the resistors 8, 9, 10 and 11, and this is the same in effect as what would be obtained by coupling the main channel signal ($L_1 + L_2 + R_1 + R_2$) alone. Generally, the signal coupled through the resistors 8 to 11 is 180 degrees out of phase with the combinations of signals appearing at the terminals C, D, E and F if the constants in equation 1 representing the stereophonic composite signal satisfies a condition $K_1 = K_2 = K_3 = 1$ or $1 > K_1 = K_2 >_{K2} > K_3$, but otherwise the former signal may be in phase with the latter.

As has been shown, according to the invention a difference in level, if any, present among individual subchannels of 4-channel stereophonic composite signals may be readily maintained. Also, it is possible to effect the level adjustment between the main channel signal and the subchannel signals to eliminate crosstalk.

Now, detailed examples of the switching means 1, 2 and 3 and the switching circuits 1*a*, 1*b*, 2*a*, 2*b*. *3a* and 3*b* in the embodiment of FIG. 1 will be given.

Figure 5:
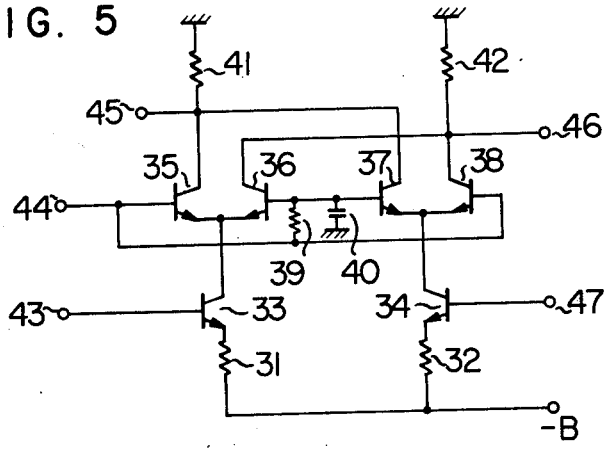
FIG. 5 is a circuit diagram showing an example of switching means employed in the embodiment of FIG. 1.

FIG. 5 shows an example of the switching means. It uses a differential amplifier type switching circuit consisting of transistors 35 and 36 and another differential amplifier type switching circuit consisting of transistors 37 and 38. These paired differential amplifier type switching circuits are connected serially with respective signal amplifier transistors 33 and 34. The switching signal is applied to a control terminal 44. If this switching means is used as the first switching means the 4-channel stereophonic composite signal is applied to one of terminals 43 and 47, while $\alpha$ times the composite signal is applied to the other terminal. If it is used as the second or third switching means, either one of the two combinations of signals from the first switching means is applied to one of the terminals 43 and 47, while B times the combination of signals is applied to the other terminal. Its output signals can be taken out from the collector side of the transistors 35 to 38, i.e., from output terminals 45 and 46. Here, the differential amplifier type switching circuit of transistors 35 and 36 corresponds to the switching circuit 1*a*, 2*a* or 3*a* shown in FIG. 1, and the other switching circuit of transistors 37 and 38 corresponds to the switching circuit 1*b*, 2*b* or 3*b*.

In case when the circuit construction of FIG. 5 is used as the first switching means, with the composite signal $M(t)$ applied to one of the terminals 43 and 47, for instance terminal 43, the 4-channel stereophonic composite signal $M(t)$ goes through the transistor 33 to the transistors 35 and 36 which are on-off switched under control by the switching signal, giving rise to the signals $P_1M(t)$ and $Q_1M(t)$ appearing at the respective terminals 45 and 46. Meanwhile, the signal $\alpha\ M(t)$ applied to the other terminal 47 goes through the transistor 34 to the transistors 37 and 38 and is also on-off switched under control by the switching signal, thus giving rise to the signals $\alpha\ Q_1M(t)$ and $\alpha\ P_1M(t)$ appearing at the respective terminals 45 and 46.

The transistors 35 and 37 have their collectors connected commonly to the terminal 45, while the transistors 36 and 38 have their collectors connected commonly to the terminal 46. The switching signal is directly applied to the transistor 35 at the base thereof, so that the switching function at the collector of this transistor is 180° out of phase with it while it goes to the transistor 37 through the emitters of the transistors 38 and 37 so that the switching function at the collector of the transistor 37 is in phase with it. In other words, the switching functions $P_1$ and $Q_1$ are provided respectively at the collectors of the transistors 35 and 37. In this state, the 4-channel stereophonic composite signal $M(t)$ goes to the emitter of the transistor 35, while the signal $\alpha\ M(t)$ goes to the emitter of the transistor 37. Thus, a signal $$P_1M(t) + \alpha\ Q_1M(t) \text{ or } Q_1M(t) + \alpha\ P_1M(t) \qquad (22)$$

is obtained from the terminal 45.

The transistors 36 and 38 are operated in a similar way except for that the switching signal is applied reversely in phase. Thus, a signal $$Q_1M(t) + \alpha\ P_1M(t) \text{ or } P_1M(t) + \alpha\ Q_1M(t) \qquad (23)$$

is obtained from the terminal 46.

As mentioned earlier, the level of the 4-channel composite signal input to one of the transistors 33 and 34 may be adjusted (through the adjustment of the value of $\alpha$) for the level adjustment between the second and third subchannel signal components to facilitate the separation adjustment.

The employment of the circuit construction of FIG. 5 as the second and third switching means in a similar way to the circuits 1*a* and 1*b* of the first switching means 1 in FIG. 1, makes it possible to obtain the relations of equations 14 to 17 and enables the level adjustment between the first and second subchannel signal components. In this case, the signal appearing at the terminal A or B is applied to one of the terminals 43 and 47, and $\beta$ times that signal is applied to the other terminal. Also, the second switching signal (for instance, the third subcarrier signal or second subcarrier signal) is applied to the terminal 44. In this manner, the operation mode as has been described earlier in connection with FIG. 1 can be obtained.

Figure 6:
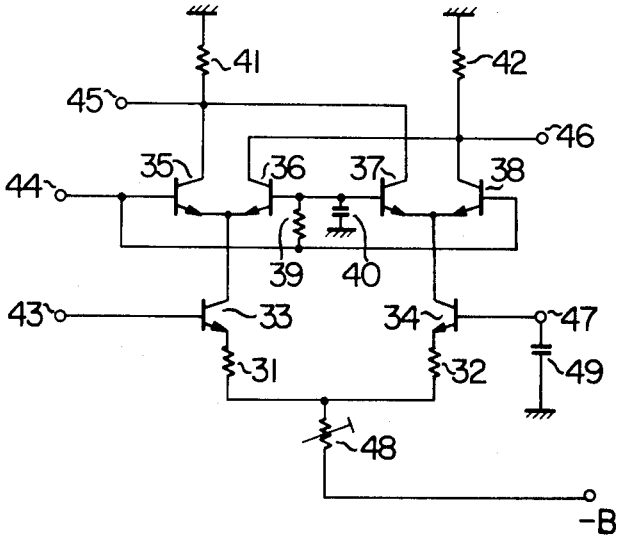
FIG. 6 is a circuit diagram showing another example of switching means employed in the embodiment of FIG. 1.

FIG. 6 shows another example of the switching means in the embodiment of FIG. 1. This circuit is similar to the above example of FIG. 5 except that a common impedance 48 is provided on the emitter side of the signal amplifier transistors 33 and 34. This circuit construction may be used where the circuit 16, 17 or 18 in the FIG. 1 embodiment is omitted. In this case, a signal is applied to input terminal 43 for transistors 35, 36 and 33 corresponding to the switching circuit 1*a*, 2*a* or 3*a* shown in FIG. 1, while it goes from the emitter of the transistor 33 over the common impedance 48 to transistor 34, which constitutes together with transistors 37 and 38 the other switching circuit 1*b*, 2*b* or 3*b*. (Here, no signal is applied to terminal 47 or the base of the transistor 34.) By so doing, the value of $\alpha$ or $\beta$ may be varied by varying the common impedance 48. In this circuit, the adjustment of $\alpha$ and $\beta$ is possible only when $\alpha < 0$ and $\beta < 0$ since the signals appearing at the collectors of the transistors 33 and 34 are 180° out of phase with each other. (In the circuit of FIG. 5, the adjustment is possible for $\alpha \gtrless 0$ and $\beta \gtrless 0$.)

Figure 7:
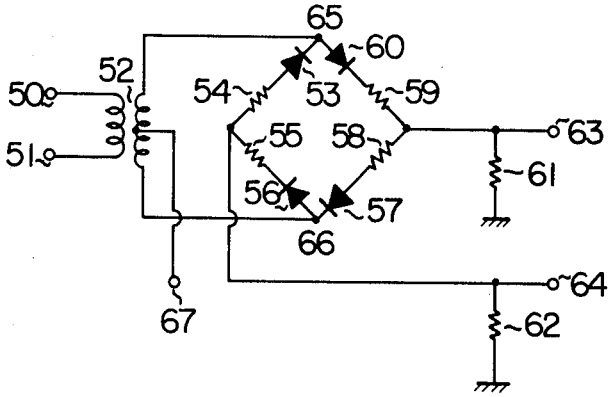
FIG. 7 is a circuit diagram showing an example of the switching circuit employed in accordance with the invention.

FIG. 7 shows a different circuit construction of the switching circuit. It employs a bridge of diodes 53, 56, 57 and 60 and a transformer 52 whose secondary winding is connected between diagonal connection points 65 and 66 of the bridge. The switching signal is applied across the primary winding of the transformer. The secondary winding of the transformer 52 is tapped mid way, and the tap is connected to a terminal 67, to which the signal to be switched (either signal $M(t)$ or $\alpha M(t)$ in the case in which this circuit is used in the first switching means) is applied. The output signals are derived from the other diagonal connection points of the bridge.

In the preceding embodiment of FIG. 1, the addition is effected between output signals of paired switching circuits, and a circuit for adjusting the degree of addition, namely circuit 16, 17 or 18, is provided before one of the paired switching circuits, namely circuit 1*b*, 2*b* or 3*b*.

Figure 8:
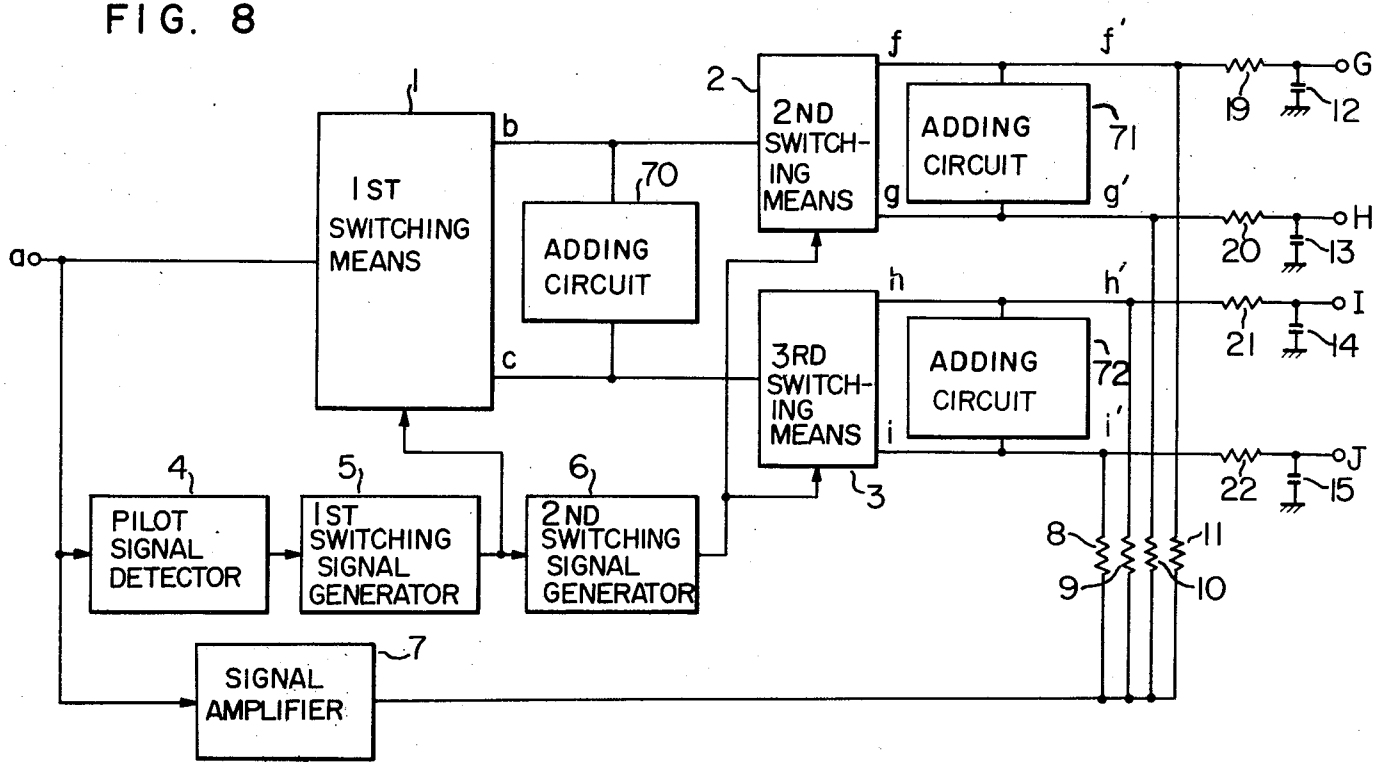
FIG. 8 is a block form representation of another embodiment of the 4-channel stereophonic demodulating system according to the invention.

FIG. 8 shows another embodiment, in which addition is carried out between two output signals produced from the same switching circuit. In this embodiment, each of switching means 1, 2 and 3 consists of a single switching circuit, and adding circuits 70, 71 and 72 are provided between the two output terminals of the respective switching means. The first switching means 1 functions in the same way as the switching circuit 1*a* in the FIG. 1 embodiment, so that signals $P_1M(t)$ and $Q_1M(t)$ are obtained from its output terminal *b* and *c*. These signals are added to each other in phase or in 180°-out-of-phase by the adding circuit 70 to obtain signals $$\left.\begin{array}{l} P_1M(t) + \alpha Q_1M(t) \\ \text{and} \quad Q_1M(t) + \alpha P_1M(t) \end{array}\right\} \qquad (24)$$

These equations are respectively the same as equations 6 and 7. Accordingly, the value of $\alpha$ may be adjusted in the adding circuit for the subchannel signal level adjustment.

FIGS. 9*a* and 9*b* show examples of the circuit construction of the adding circuit. The circuit of FIG. 9*a* uses a semi-fixed resistor 73 as common impedance for the adjustment of the addition degree or rate. In this circuit, in-phase addition is effected. The FIG. 9*b* circuit effects 180°-out-of-phase addition because it uses transistors 74 and 75 whose emitters are connected to each other.

The second and third switching means in the embodiment of FIG. 8 function in the same way as the respective switching circuits 2*a* and 3*a* in the embodiment of FIG. 1, so that similar to the output signals from the circuits 2*a* and 3*a* in FIG. 1 signals $$\left.\begin{array}{l} P_2\{P_1M(t) + \alpha Q_1M(t)\} \\ Q_2\{P_1M(t) + \alpha Q_1M(t)\} \\ P_2\{Q_1M(t) + \alpha P_1M(t)\} \\ \text{and} \quad Q_2\{Q_1M(t) + \alpha P_1M(t)\} \end{array}\right\} \qquad (25)$$

appear from respective output terminals *f*, *g*, *h* and *i*. If the adding circuits 71 and 72 are set to $\beta$, we can obtain at respective terminals *f'*, *g'*, *h'* and *i'* signals $$\left.\begin{array}{l} P_2\{P_1M(t) + \alpha Q_1M(t)\} + \beta Q_2\{P_1M(t) + \alpha Q_1M(t)\} \\ Q_2\{P_1M(t) + \alpha Q_1M(t)\} + \beta P_2\{P_1M(t) + \alpha Q_1M(t)\} \\ P_2\{Q_1M(t) + \alpha P_1M(t)\} + \beta Q_2\{Q_1M(t) + \alpha P_1M(t)\} \\ \text{and} \quad Q_2\{Q_1M(t) + \alpha P_1M(t)\} + \beta P_2\{Q_1M(t) + \alpha P_1M(t)\} \end{array}\right\} \qquad (26)$$

These equations are respectively the same as equations 14 to 17. Accordingly, by adjusting the value of $\beta$ it is possible to obtain subchannel signal level adjustment as in the embodiment of FIG. 1. The circuit constructions of FIGS. 9*a* and 9*b* may also be employed for the adding circuits 71 and 72.

Similar to the embodiment of FIG. 1, the 4-channel composite signal output of signal amplifier 7 is coupled through resistors 8, 9, 10 and 11 to thereby adjust the level of the main channel signal component with respect to the subchannel signal components and obtain separate $L_1$, $L_2$, $R_1$ and $R_2$ signals at respective output terminals.

In the preceding embodiments, the level adjustment of the main channel signal component with respect to the subchannel signal components has been made by combining the signals appearing at the respective four output terminals of the demodulating circuit with respective signals obtained through the separate resistors 8, 9, 10 and 11.

FIG. 10 shows a further embodiment, which is similar to the preceding embodiments inasmuch as the demodulation is effected by applying the output signals of first switching means 1 to second and third switching means 2 and 3, but in which the level adjustment is done by combining signals appearing at output terminals A and B of the first switching means 1 with a signal obtained by coupling the 4-channel stereophonic composite signal through a gain control means 105 and a low-pass filter 106.

The low-pass filter 106 has to remove at least the third subchannel signal component, because if the third subchannel signal component appears at the terminals A and B the separation adjustment cannot be obtained. The separation adjustment, however, can be obtained irrespective of whether the low-pass filter 106 passes only the main channel signal component or it passes the main channel component and the first and second subchannel components. Also, by conducting phase inversion in the circuit 105 and producing signals 180° out of phase with each other for combination with the first switching means output signals at the output terminals A and B, it is generally possible to have the main channel signal at the same level as the subchannel signals.

The description so far has been concerned with the mode of applying the first subcarrier wave to the first switching means and the second or third subcarrier wave to the second and third switching means. Alternatively, the switching signal applied to the first switching means and the one applied to the second and third switching means may be interchanged.

Also, the preceding embodiments have been concerned with the 4-channel stereophonic composite signal given by equation 1, the composite signal input may additionally include a second pilot signal such as $K\sin 3/2\omega t$, $K\sin 2\omega t$ and $K\sin 5/2\omega t$. Further, by interchanging the factors C and D in the second and third terms in equation 1 essentially the same operation can be obtained except for the result that $R_1$ and $R_2$ are interchanged. Furthermore, it is possible to substitute a term representing a single side band signal to the fourth term in equation 1.

FIG. 11 shows a still further embodiment of the invention. In this embodiment, a 4-channel stereophonic composite signal applied to an input terminal *a* is fed to parallel switching means 83, 84, 85 and 86 and to a pilot detector 4. The pilot signal detector 4 derives a pilot signal, which is applied to a first switching generator 5 to produce a first switching signal, which is in turn applied to a second switching signal generator 6 to produce a second switching signal. The first and second switching signals are added to gates 87, 88, 89 and 90 of the respective switching means 83 to 86. These gates are rendered "on" on a time division basis to cause the switching action in respectively associated paired switching circuits 95 and 96, 97 and 98, 99 and 100, and 101 and 102 in the individual switching means in different periods.

FIG. 12 shows an example of the mode of switching the gates 7 to 90. In this mode, the first subcarrier wave (at 38 kHz) as indicated at *a* and the third subcarrier wave (at 76 kHz) as indicated at *b* are used respectively as the first and second switching signals, with the first gate 87 rendered "on" when the 38-kHz and 76-kHz switching signals are both positive (as indicated at *c*), the second gate 88 rendered "on" when these signals are respectively positive and negative (as indicated at *d*), the third gate 89 rendered "on" when these signals are respectively negative and positive (as indicated at *e*) and the fourth gate 90 rendered "on" when these signals are both negative (as indicated at *f*).

FIG. 13 shows another gate switching mode, in which the first subcarrier wave and the second subcarrier wave (having the same frequency as but 90° out of phase with the first subcarrier wave) are used respectively as the first and second switching signals. In this mode, the first gate 87 is rendered "on" when the first and second switching signals are both positive, the second gate 88 is rendered "on" when these signals are respectively positive and negative, the third gate 89 is rendered "on" when these signals are both negative, and the fourth gate 90 is rendered "on" when these signals are respectively negative and positive.

In case the composite signal input to the input terminal *a* is given by equation 1, the $L_1$, $L_2$, $R_1$ and $R_2$ signals occur in the order as shown in FIG. 3. Therefore, the switching circuit 95 in the switching means 83, for instance, switches only the signal $L_1$. With this switching circuit alone, however, perfect separation could not be expected. This is because the 4-channel composite stereophonic composite signal of equation 1 is not obtained on the basis of switching by any rectangular wave and the constants $K_1$, $K_2$ and $K_3$may be different from one another. Accordingly, the switching circuit 95 is paired with the switching circuit 96 for effecting addition with switching functions $P_3$ and $Q_3$ bearing a 180°-out-of-phase relation to each other, function $P_3$ being provided to the circuit 95 and function $Q_3$ to the circuit 96. The rate of the addition is adjusted by a gain adjusting circuit 91, which is provided before the switching circuit 96 and serves to multiply the level of the composite signal $M(t)$ by $\gamma(\gamma > 0$ or $\gamma < 0)$. In the other switching means 84, 85 and 86, similar addition is conducted with respective switching functions $P_4$(and $Q_4$), $P_5$ (and $Q_5$) and $P_6$ (and $Q_6$) for switching by the output of the respective gates 88, 89 and 90, with the rate of addition being pre-adjusted by respective gain adjusting circuits 92, 93 and 94. In this way, we can obtain signals $$\left.\begin{array}{l} P_3M(t) + \gamma\, Q_3M(t) \\ P_4M(t) + \gamma\, Q_4M(t) \\ P_5M(t) + \gamma\, Q_5M(t) \\ \text{and} \quad P_6M(t) + \gamma\, Q_6M(t) \end{array}\right\} \qquad (27)$$

at respective output terminals C, D, E and F. In other words, the signals $L_1$, $L_2$, $R_1$ and $R_2$ can be separated and derived from the output side of the respective switching means 83, 84, 85 and 86.

In case the composite signal $M(t)$ is given by an equation obtained by interchanging C and D in the third and fourth terms in equation 1, the order of occurrence of signals is as shown in FIG. 4. In this case, the signals $L_1$, $L_2$, $R_2$ and $R_1$ are obtained from the respective switching means 83, 84, 85 and 86, and this result is the same as that of the above case except for that the signals $R_1$ and $R_2$ are interchanged.

It is to be emphasized that where a 4-channel stereophonic composite signal is demodulated by using a first switching signal and a second switching signal, it is again possible with the embodiment of FIG. 11 to obtain separation adjustment through addition between the outputs of paired switching circuits.

While in the above embodiment of FIG. 11 the circuits 91, 92, 93 and 94 for the level adjustment are provided before the respective switching circuits 96, 98, 100 and 102, similar effects may also be obtained by providing the circuits 91 to 94 after the respective switching circuits 96, 98, 100 and 102.

As has been described in the foregoing, with the 4-channel stereophonic demodulating system according to the invention stereophonically related four signals are separated through switching means by using a first and a second switching signals, with addition between outputs of the switching means being provided, so that it is possible to simply obtain the separation control.

We claim:

1. A 4-channel stereophonic demodulating system for demodulating a 4-channel stereophonic composite signal containing a main channel signal component constituted by a first one of four different combinations of signals, said combinations of signals being obtained from four signals stereophonically related to one another, a first subchannel signal component obtained through suppressed-carrier amplitude modulation of a second one of said combinations of signals on a first subcarrier wave, a second subchannel signal component obtained through suppressed-carrier amplitude modulation of a third one of said combinations of signals on a second subcarrier wave 90° out of phase with respect to said first subcarrier wave, a third subchannel signal component obtained through suppressed-carrier amplitude modulation of a fourth one of said combinations of signals on a third subcarrier wave at double the frequency of said first and second subcarrier waves, at least one of said subchannel signal components having a level different from the levels of the other subchannel signal components, and a pilot signal having a frequency one half of said first subcarrier wave, said demodulating system comprising:

means for producing a first switching signal at a harmonic frequency of said pilot signal;

means for producing a second switching signal at a harmonic frequency of said pilot signal;

first switching means supplied with said 4-channel stereophonic composite signal and operated by said first switching signal for producing a pair of output signals from the supplied composite signal;

second and third switching means operated by said second switching signal for producing four audio signals at their output terminals from the output signals of said first switching means;

means for supplying the outputs of said first switching means to said second and third switching means;

means for deriving said four audio signals from the outputs of said second and third switching means;

at least one of said first, second and third switching means having two switching circuits, said two switching circuits being supplied with the input signals of the switching means having said two switching circuits, said two switching circuits being operated by one of said switching signals; and supplying means for supplying an output signal of one of the two switching circuits of said switching means having said two switching circuits to an output signal of the other switching circuit thereof to obtain level adjustment between said subchannel signal components having different levels.

2. A 4-channel stereophonic demodulating system according to claim 1, wherein said two switching circuits receive respective 4-channel stereophonic composite signals or respective output signals of said first switching means, the output of one switching circuit being connected to that of the other switching circuit in an in-phase relation to each other.

3. A 4-channel stereophonic demodulating system according to claim 1, wherein said two switching circuits receive respective 4-channel stereophonic composite signals or respective output signals of said first switching means, the output of one switching circuit being connected to the other switching circuit in a 180° out-of-phase relation to each other.

4. A 4-channel stereophonic demodulating system according to claim 3, wherein at least one of said switching means comprises two differential amplifier type switching circuits and two signal amplifier individually connected serially with respective ones of said differential amplifier type switching circuits, a switching signal being applied to a control electrode of each said differential amplifier type switching circuit, both said signal amplifiers receiving respective 4-channel stereophonic composite signals or respective output signals from said first switching means, common impedance means being provided for level adjustment of the individual channel signal components relative to one another.

5. A 4-channel stereophonic demodulating system according to claim 1, wherein said first switching means has two switching circuits, said two switching circuits are supplied with said 4-channel stereophonic composite signal and operated by said first switching signal, and said supplying means includes a means for adding an output signal of one of the two switching circuits of said first switching means to an output signal of the other switching circuit to adjust the levels between said second and third subchannel signal components at the output of the first switching means when said first and second switching signals are at the frequencies of the first and third subcarrier signals.

6. A 4-channel stereophonic demodulating system according to claim 1, wherein each of said second and third switching means has two switching circuits, said two switching circuits are supplied with output signals of said first switching means, and operated by said second switching signal, and said supplying means includes a means for supplying an output signal of one of the two switching circuits of said second and third switching means to an output signal of the other switching circuit to adjust the levels between said first and second subchannel signal components at the outputs of the second and third switching means when said first and second switching signals are at the frequencies of the first and third subcarrier signals.

7. A 4-channel stereophonic demodulating system according to claim 1, wherein said first switching means has two switching circuits, said two switching circuits are supplied with said 4-channel stereophonic composite signal, and operated by said first switching signal, and said supplying means includes a means for supplying an output signal of one of the two switching circuits of said first switching means to an output signal of the other switching circuit to adjust the levels between said second and third subchannel components at the outputs of the first switching means when said first and second switching signals are at the frequencies of the first and second subcarrier signals.

8. A 4-channel stereophonic demodulating system according to claim 1, wherein said second and third switching means each has two switching circuits, said two switching circuits are supplied with output signals of said first switching means, and operated by said second switching signal; and said supplying means includes a means for supplying an output signal of one of the two switching circuits of said second and third switching means to an output signal of the other switching circuit to adjust the levels between said first and third subchannel signal components at the outputs of the second and third switching means when said first and second switching signals are at the frequencies of the first and second subcarrier signals.

9. A 4-channel stereophonic demodulating system according to claim 1, wherein said switching circuits for at least one of said switching means comprises a diode bridge, an input signal being applied to a pair of diagonal connection points in said diode bridge, an output signal being derived from the other pair of diagonal connection points in said diode bridge.

10. A 4-channel stereophonic demodulating system for demodulating a 4-channel stereophonic composite signal containing a main channel signal component formed of one of four different combinations of signals, said combinations of signals being obtained from four signals stereophonically related to one another, a first subchannel signal component obtained through suppressed-carrier amplitude modulation of a second one of said combinations of signals, a second subchannel signal component obtained through suppressed-carrier amplitude modulation of a third one of said combinations of signals on a subcarrier wave 90 degrees out-of-phase with respect to said first subchannel signal component, a third subchannel signal component obtained through suppressed-carrier amplitude modulation of a fourth one of said combinations of signals on a subcarrier wave at double the frequency of said first and second subcarrier signal components, at least one of said subchannel signal components having a level different from those of the other subchannel signal components, and a pilot signal, said demodulating system comprising four switching means for demodulating said 4-channel stereophonic composite signal, said four switching means being supplied with said 4-channel composite signal, and means for deriving said four signals stereophonically related to one another from the outputs of said four switching means, each of said four switching means including two switching circuits and a gate circuit coupled to said switching circuits, the output of one of said two switching circuits being connected to the output of said switching means and the inputs of both switching circuits being supplied with said 4-channel composite signal, said gate circuits being supplied with first and second switching signals and being on-off controlled by said first and second switching signals, said switching signals being related to said pilot signal and its harmonics, said switching circuits being switched at different times by the output signals of said gate circuits, and means for adding the signals applied to said two switching circuits for level adjustment of the subchannel signal components relative to one another.

11. A 4-channel stereophonic demodulating system for demodulating a 4-channel stereophonic composite signal containing a main channel signal component constituted by a first one of four different combinations of signals, said combinations of signals being obtained from four signals stereophonically related to one another, a first subchannel signal component obtained through suppressed-carrier amplitude modulation of a second one of said combinations of signals on a first subcarrier wave, a second subchannel signal component obtained through suppressed-carrier amplitude modulation of a third one of said combinations of signals on a second subcarrier wave 90 degrees out of phase with respect to said first subcarrier wave, a third subchannel signal component obtained through suppressed-carrier amplitude modulation of a fourth one of said combinations of signals on a third subcarrier wave at double the frequency of said first and second subcarrier waves, at least one of said subchannel signal components having a level different from the levels of the other subchannel signal components, and a pilot signal having a frequency one half of said first subcarrier wave, said demodulating system comprising:

means for producing a first switching signal at a harmonic frequency of said pilot signal;

means for producing a second switching signal at a harmonic frequency of said pilot signal;

first switching means supplied with said 4-channel stereophonic composite signal and operated by said first switching signal for producing a pair of output signals from the supplied composite signal;

second and third switching means operated by said second switching signal for producing four audio signals at their output terminals from the output signals of said first switching means;

means for supplying the outputs of said first switching means to said second and third switching means;

means for deriving said four audio signals from the outputs of said second and third switching means;

said first, second and third switching means each having two switching circuits, said two switching circuits being supplied with input signals of said switching means, and operated by said first and second switching signals; and supplying means for supplying an output signal of one of the two switching circuits of each of said switching means to an output signal of the other switching circuit of said each switching means to obtain level adjustment between the first, second and third subchannel signal components.

12. A 4-channel stereophonic demodulating system according to claim 11, wherein the 4-channel stereophonic composite signal is added, after removal of at least the third subchannel component therein, to the output signals from said first switching means for adjusting the levels between the main channel signal component and the subchannel signal components at the outputs of said second and third switching means.

13. A 4-channel stereophonic demodulating system according to claim 11, wherein said first, second and third switching means comprise two differential amplifier type switching circuits and two signal amplifiers individually connected serially with respective ones of said differential amplifier type switching circuits, a switching signal being fed to a control electrode of each said differential amplifier type switching circuit, both control electrodes of said signal amplifiers receiving respective 4-channel stereophonic composite signals or respective output signals from said first switching means, the level of the signal received by one of said signal amplifiers being adjustable.

14. A 4-channel stereophonic demodulating system for demodulating a 4-channel stereophonic composite signal containing a main channel signal component constituted by a first one of four different combinations of signals, said combinations of signals being obtained from four signals stereophonically related to one another, a first subchannel signal component obtained through suppressed-carrier amplitude modulation of a second one of said combinations of signals on a first subcarrier wave, a second subchannel signal component obtained through suppressed-carrier amplitude modulation of a third one of said combinations of signals on a second subcarrier wave 90 degrees out of phase with respect to said first subcarrier wave, a third subchannel signal component obtained through suppressed-carrier amplitude modulation of a fourth one of said combinations of signals on a third subcarrier wave at double the frequency of said first and second subcarrier waves, at least one of said subchannel signal components having a level different from the levels of the other subchannel signal components, and a pilot signal having a frequency one half of said first subcarrier wave, said demodulating system comprising:

means for producing a first switching signal at a harmonic frequency of said pilot signal;

means for producing a second switching signal at a harmonic frequency of said pilot signal;

first switching means supplied with said 4-channel stereophonic composite signal and operated by said first switching signal for producing a pair of output signals from the supplied composite signal;

second and third switching means operated by said second switching signal for producing four audio signals at their output terminals from the output signals of said first switching means;

means for supplying the outputs of said first switching means to said second and third switching means;

means for deriving said four audio signals from the outputs of said second and third switching means;

at least one of said first, second and third switching means having two switching circuits, said two switching circuits being supplied with the input signals of the switching means having said two switching circuits, and operated by one of said switching signals;

supplying means for supplying an output signal of one of the two switching circuits of said switching means having two switching circuits to an output signal of the other switching circuit thereof to obtain level adjustment between said subchannel signal components having different levels; and means for adding said 4-channel stereophonic composite signal at least including the main channel component to the outputs of the second and third switching circuits.

15. A 4-channel stereophonic demodulating system for demodulating a 4-channel stereophonic composite signal containing a main channel signal component constituted by a first one of four different combinations of signals, said combinations of signals being obtained from four signals stereophonically related to one another, a first subchannel signal component obtained through suppressed-carrier amplitude modulation of a second one of said combinations of signals on a first subcarrier wave, a second subchannel signal component obtained through suppressed-carrier amplitude modulation of a third one of said combinations of signals on a second subcarrier wave 90 degrees out of phase with respect to said first subcarrier wave, a third subchannel signal component obtained through suppressed-carrier amplitude modulation of a fourth one of said combinations of signals on a third subcarrier wave at double the frequency of said first and second subcarrier waves, at least one of said subchannel signal components having a level different from the levels of the other subchannel signal components, and a pilot signal having a frequency one half of said first subcarrier wave, said demodulating system comprising:

means for producing a first switching signal at a harmonic frequency of said pilot signal;

means for producing a second switching signal at a harmonic frequency of said pilot signal;

first switching means supplied with said 4-channel stereophonic composite signal and operated by said first switching signal for producing a pair of output signals from the supplied composite signal;

second and third switching means operated by said second switching signal for producing four audio signals at their output terminals from the output signals of said first switching means;

means for supplying the outputs of said first switching means to said second and third switching means;

means for deriving said four audio signals from the outputs of said second and third switching means;

at least one of said first, second and third switching means including two output terminals; and an adding circuit connected between said two output terminals of at least one of said switching means to obtain level adjustment between said subchannel signal components having different levels.

16. A 4-channel stereophonic demodulating system according to claim 15, wherein a common impedance element is provided between two output terminals of at least one switching circuit for in-phase addition.

17. A 4-channel stereophonic demodulating system according to claim 15, wherein an adding circuit is provided between two output terminals of at least one switching circuit for 180° out-of-phase addition.

* * * * *